United States Patent [19]

Sahasrabudhe et al.

[11] B 3,992,698

[45] Nov. 16, 1976

[54] FAIL-SAFE SPEED COMMAND SIGNAL DECODER

[75] Inventors: Arun P. Sahasrabudhe, Monroeville, Pa.; Michael V. McGinty, Alameda, Calif.

[73] Assignee: Westinghouse Electric Corporation, Pittsburgh, Pa.

[22] Filed: Apr. 15, 1975

[21] Appl. No.: 568,226

[44] Published under the second Trial Voluntary Protest Program on February 24, 1976 as document No. B 568,226.

[52] U.S. Cl. ..... 340/167 B; 340/146.1 BA

[51] Int. Cl.[2] ..... H04Q 9/00; G08C 25/00

[58] Field of Search ..... 340/147 R, 167 R, 171 R, 340/168 R, 164 R, 163, 167 B, 146.1 BA

[56] References Cited

UNITED STATES PATENTS

| | | | |
|---|---|---|---|
| 3,354,433 | 11/1967 | Minc | 340/167 B |
| 3,577,187 | 4/1971 | Benson | 340/163 |
| 3,588,825 | 6/1971 | Shook | 340/163 |
| 3,624,603 | 11/1971 | Delcomyn | 340/146.1 BA |
| 3,703,706 | 11/1972 | Ogura et al. | 340/146.1 BA |
| 3,737,577 | 6/1973 | Birkin | 178/23 A |
| 3,742,481 | 6/1973 | Nickerson | 340/164 R |
| 3,790,821 | 2/1974 | Adamson | 340/365 E |

*Primary Examiner*—Donald J. Yusko
*Attorney, Agent, or Firm*—R. G. Brodahl

[57] ABSTRACT

In a typical transportation vehicle control system, coded control information is transmitted to the transportation vehicles on vehicle command signals comprised of multiple message frequencies. A decoder is disclosed for decoding, in a fail-safe manner, information from message words which are comprised of message units carried on the multiple message frequencies. Vehicle speed command signals which are received by an antenna are amplified and frequencies which are substantially the same as the message frequencies are filtered from these signals. The filtered message frequencies are again amplified before message units are separately detected from each message frequency by a related filter-discriminator. The message units detected from a first message frequency by the related filter discriminator are delayed for the number of message units which comprise a message word. The message units detected from a second message frequency by the related filter-discriminator are inverted. If a threshold detector has determined that the filtered signals should be valued, the delayed message units are compared with the inverted message units and, when they correspond, the equivalent message unit is stored in relation to a clock which is synchronized with the rate that message units are detected. A decoding tree decodes information from message words comprised of stored message units.

When the delayed message unit does not correspond with the inverted message unit, that message unit and all the stored message units are reset so that there is no information word for the decoder tree to decode. Non-correspondence between the delayed message unit and the inverted message unit may be due to transient responses of the filter, noise received by the antenna, or failure of a component in the receiver. In such case, no control information will be delivered to the vehicle because all the stored message units are reset. Since a no-information condition is deemed to be safe for the transportation vehicle control system, the receiver will fail in a safe manner and may therefore be described as fail-safe.

3 Claims, 4 Drawing Figures

FAIL-SAFE SPEED COMMAND SIGNAL DECODER

CROSS REFERENCE TO RELATED APPLICATIONS

References made to concurrently filed and copending applications entitled Multi-Channel Signal Decoder, Serial No. 558108, filed Mar. 13, 1975, on behalf of T. C. Matty and A. Sahasrabudhe, and Quad-State Signal Receiver Ser. No. 558097, filed Mar. 13, 75, on behalf of T. C. Matty and A. Sahasrabudhe. Each of the referenced applications is assigned to the assignee of the present invention.

BACKGROUND OF THE INVENTION

In a typical transportation system operative with comma-free, binary coded vehicle control signals, vehicle speed command information is transmitted on multiple message frequencies (e.g. 5 KHz and 10 KHz) which represents binary message units "1" and "0". A digital frequency modulation method (FM), frequency shift key modulation method (FSK), or phase shift key modulation method (PSK) is employed to carry binary coded, speed command information to the transit vehicles. Before the information transmitted on the message frequencies can be utilized, it must be decoded according to the particular modulation method used by the system. This decoding must be performed in a manner such that extraneous signals which are received will not cause the vehicle to operate in an unsafe manner.

In attempting to achieve this safety standard, vehicle command signal decoders of the prior art used a limiting amplifier to establish "capture effect" by which a coded message frequency of large amplitude could screen out extraneous signals of lower amplitude. The gain of the limiting amplifier was high enough that any input signal of a predetermined minimum amplitude would result in an output of limited maximum amplitude. Therefore, as long as the amplitude of the message frequency was large enough to maintain the predetermined minimum amplitude of the input signal while, at the same time, offsetting any other input signals, the limited amplitude output of the limiting amplifier was determined by the message frequency. For example, an input message frequency whose amplitude was larger than twice as large as the amplitude of any other input signal (noise or transient filter responses) would screen out the other signals so that the limited maximum output of the limiting amplifier would be determined by the input message frequency.

The problem with the prior art decoders was caused by the high gain of the limiting amplifier. For example, if the output of a filter in the prior art decoder were to contain a transient response while the message frequency being transmitted was outside the bandwidth of the filter, the limiting amplifier could recognize this transient response as a valid input and amplify it so that the detector would detect an inaccurate message unit causing the decoder to decode inaccurate information. The high gain of the limiting amplifier could also cause errors in detection where the large amplitude message frequency was lost. When the large amplitude message frequency was not present to screen out the smaller, extraneous signals, the limiting amplifier could amplify these extraneous signals also causing the decoder to decode inaccurate information. Also, the failure of a filter could allow a signal outside the bandwidth of the filter to reach the input of the limiting amplifier where it could be amplified and again cause the decoder to decode inaccurate information.

To the extent that the decoding errors caused by the use of a limiting amplifier in the prior art decoder manifested themselves, transportation vehicle control systems that used this prior art design had limited safety margin. It was the purpose of the present invention to provide a transportation vehicle signal decoder that could significantly improve transportation system safety by eliminating the decoding errors caused by limiting amplifiers.

SUMMARY OF THE INVENTION

The present transportation vehicle speed command signal decoder isolates all message frequencies of the vehicle command signal and then amplifies these signals to a pre-determined maximum level. The message frequencies are then differentiated according to their frequencies and message units detected from each frequency. The message units detected from a first message frequency are delayed while the message units detected from a second message frequency are inverted. If the delayed message unit corresponds in a fail-safe manner with the inverted message unit, an equivalent message unit is stored. The decoding tree then decodes information if there are enough message units stored to comprise a message word. If the delayed message unit does not correspond with the inverted message unit due to an error in detecting the message units from the vehicle speed command signal, no message unit is stored and the previously stored message units are reset. Because the decoding tree decodes no information unless there are enough stored message units to comprise a message word, and because there are no stored message units immediately after an error in detecting the message units from the vehicle speed command signal, no information is decoded immediately after an error in detecting the message units. Since a no-decoded-information condition is deemed to be a safe condition for the system, the decoder is fail-safe.

PREFERRED EMBODIMENT OF THE INVENTION

The preferred embodiment of the invention discloses apparatus for decoding a comma-free, binary coded, digital speed command signal on-board a transportation system vehicle. This preferred embodiment provides a more accurate, safer decoder than transportation vehicle speed command decoders of the prior art.

Figure 1:
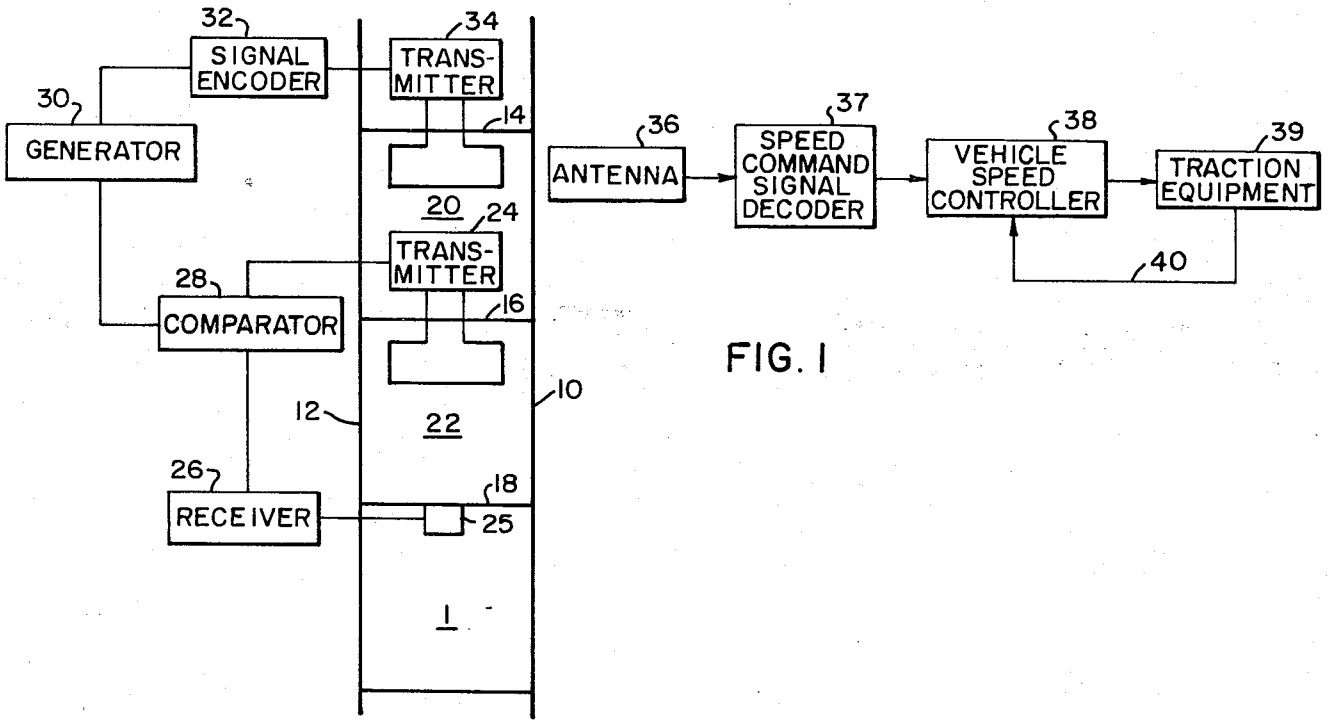
FIG. 1 is a functional block diagram of a transportation vehicle control system in which the present invention could be used.

FIG. 1 is a block diagram representation of a vehicle control system in which the disclosed decoder may be used. The vehicle pathway 1 consists of continuous metal rails 10 and 12 which will accommodate the wheels of the vehicle (not shown). Metal rails 10 and 12 are crossected by shorting bars 14, 16 and 18 which define signal blocks 20 and 22 within the vehicle pathway 1. A first transmitter 24, located at shorting bar 16, transmits a signal through metal rails 10 and 12 of signal block 22 and through a coil 25 located at shorting bar 18 to receiver 26. At the same time, the signal of transmitter 24 is sent to comparator 28, where it is compared with the signal received by receiver 26. Because the wheels and axles of a vehicle which is present within signal block 22 will shunt the signal of transmitter 24 around coil 25, comparator 28 can detect the presence of a vehicle in signal block 22 by using the relative strengths of the transmitted and received signals. The comparator 28 signals a speed code generator 30, to which it is connected, as to whether a vehicle is present in signal block 22. The speed code generator uses this signal, along with other inputs, to determine the value of the vehicle speed command signal. The vehicle speed command signal is then delivered to a command signal encoder 32 where the vehicle speed command signal is coded in accordance with a predetermined modulating method (e.g. FM, FSK, or PSK). The coded vehicle command signal is then conveyed to a second transmitter 34 which transmits it through the rails of signal block 20. The vehicle control system thus far described is well known and is explained in U.S. Pat. No. 3,526,378 of G. M. Thorne-Booth.

When a vehicle is present in signal block 20, the coded vehicle speed command signal traveling through rails 10 and 12 of signal block 20 is received through vehicle antenna 36. This received signal is delivered to the speed command signal decoder 37 which is the preferred embodiment of the present invention. As explained later, the speed command signal decoder decodes, in a fail-safe manner the coded vehicle speed command signal to produce the command signal which was generated by speed code generator 30.

The decoded vehicle command signal is provided to the vehicle speed controller 38 which excites the vehicle traction equipment 39 according to a vehicle speed feedback signal on line 40. The traction equipment 39 may be comprised of a chopper or equivalent motor control apparatus, motors, gears, axles and wheels. If the vehicle speed controller 38 receives no vehicle command signal, it provides no excitation to the traction equipment 39 which condition is deemed to be the safest to vehicle passengers.

Figure 2:
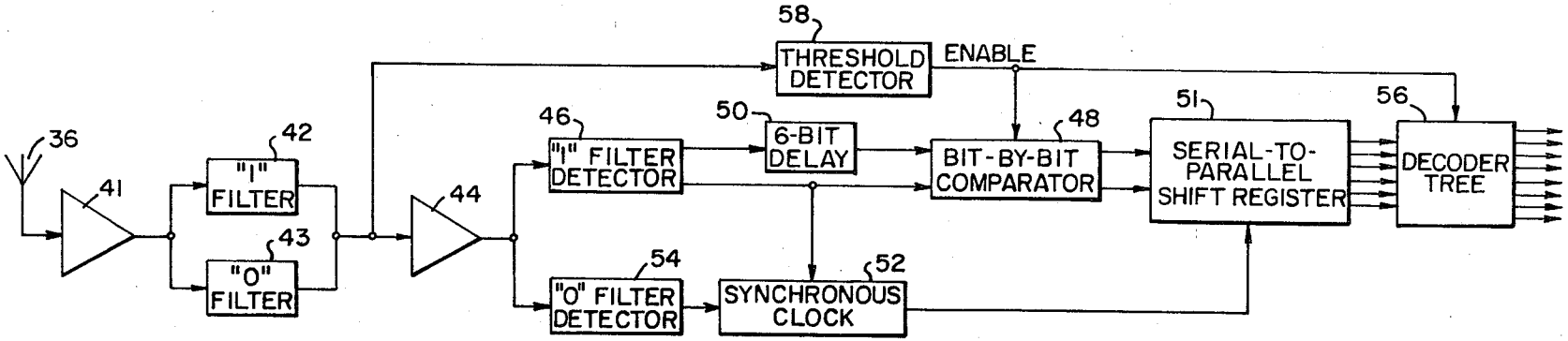
FIG. 2 PRIOR ART
FIG. 2 represents a block diagram of a vehicle cmmand signal receiver of the prior art.

FIG. 2 is a block diagram of the vehicle speed command signal decoder of the prior art which decodes vehicle speed signals from message words comprised of a predetermined number of message units. The antenna 36 receives the binary coded speed command signal comprised of PSK modulated frequencies of 5 KHz and 10 KHz which represent the binary message units "1" and "0" respectively. The signal received by antenna 36 is sent to pre-amplifier/clipper 41 which delivers a controlled amplitude signal to filters 42 and 43. The bandwidth of filter 42 contains the 5 KHz message frequency representing the "1" message units and the bandwidth of filter 43 contains the 10 KHz message frequency representing the "0" message units.

The amplitudes of frequencies isolated by filters 42 and 43 were amplified to a predetermined limited amount by limiting amplifier 44. Limiting amplifier 44 was used to establish "capture effect" which allowed the message frequencies of the vehicle speed command signal to screen out conflicting extraneous signals received by antenna 36 so that the decoded speed signal was determined from the message frequencies of the vehicle command signal. The amplitudes of the message frequencies were sufficiently greater than the amplitudes of extraneous signals received by antenna 36 so that the input to the limiting amplifier 44 was determined by the message frequencies. The gain of the limiting amplifier 44 was high enough that any input signal of a predetermined minimum amplitude would result in an output having a limited maximum amplitude. Therefore, the output of limiting amplifier 44 was a signal having a predetermined maximum amplitude and whose frequency was determined by the message frequencies of the speed command signal.

An emitter-detector 46 examined the output of amplifier 44 and detected "1" message units and "0" message units (the absence of "1" message units) from the lower message frequency. The detected message units were delivered to a bit-by-bit comparator 48 and, at the same time, to a six-bit delay 50. Upon the detection of each message unit, the six-bit delay 50 delivered the message unit which had been detected six message units previously to the bit-by-bit comparator 48. Therefore, the message unit compared in the bit-by-bit comparator 48 was the message unit currently detected by filter detector 46 and the message unit that had been delayed for six message units.

If threshold detector 58 determined that the filtered frequencies of filters 42 and 43 had at least a predetermined minimum amplitude so that an enable signal was provided, and if the delayed message unit and the current message unit corresponded, the message unit was transferred from the bit-by-bit comparator 48 to a serial-to-parallel shift register 51 according to synchronous clock 52. The synchronous clock 52 determined the rate of message unit storage in the serial-to-parallel shift register 51 according to the detection of "1" message unit by filter detector 46 or a "0" message unit by filter detector 54 which is operative with the 10 KHz message frequency. When serial-to-parallel shift register 51 contained six message units, a message word was constituted which was decoded by decoder tree 56 provided the enable signal of threshold detector 58 was present. Since the message frequencies correspond to the binary message units in the coded speed command signal and, since the frequency of the output of limiting amplifier 44 determines the message units that are detected by filter detector 46, the message units in the coded speed command signal determined the message units in the decoded message word.

If, however, the delayed message unit and the current message unit did not correspond, the bit-by-bit comparator 48 transferred a reset signal to serial-to-parallel shift register 51 which cleared shift register 51 of all previously stored message units thereby causing decoder tree 56 to have no output until the serial-to-parallel shift register 51 again contained enough information units to comprise an information word. Therefore, each time the message unit detected by filter-detector 46 did not agree with the message unit which had been delayed for six message units, the serial-to-parallel shift register was reset and no message word was decoded until a new message word was stored. However, this prior art system could not account for periodic message unit errors that occurred six message units apart. For example, assume that filter-detector 46 erroneously detects a message unit that does not correspond with the delayed message unit. Since the message units do not compare, serial-to-parallel shift register 51 is reset and no information is decoded until another message word has been stored in the serial-to-parallel shift register 51. However, the erroneous current information bit that is compared in the bit-by-bit comparator 48 is also stored in six bit delay 50. Therefore, if the same error were to occur six message units later, these erroneous message units would agree and the erroneous message unit would be stored in shift register 51 and decoded by the decoder tree 56. Allowing this erroneous information to be decoded could cause an unsafe speed command signal to be delivered to the vehicle speed controller 38 (FIG. 1). The erroneous detection of the message unit could be due to transient responses of filters 42 or 43; a noise signal received by antenna 36; or a component failure in the preamplifier 41, filters 42 or 43, limiting amplifier 44, or filter-detector 46.

Figure 3:
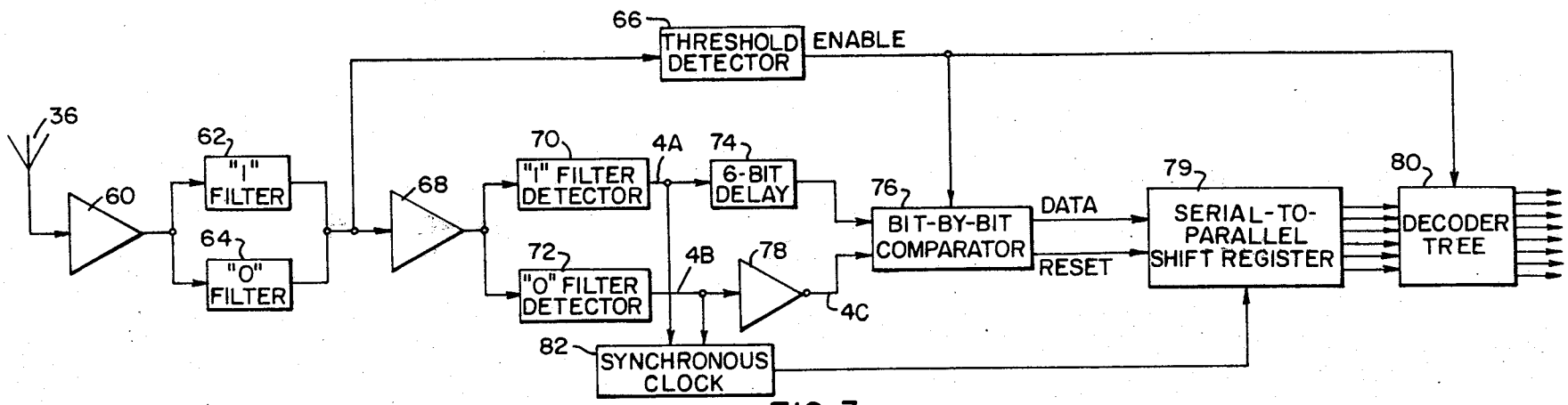
FIG. 3 is a block diagram of the preferred embodiment of the present invention.

FIG. 3 is a functional block diagram of the preferred embodiment of the present apparatus for decoding vehicle speed signals from message words detected from message frequencies of the vehicle speed command signal. The antenna 36 receives the binary coded speed command signal comprised of PSK modulated message frequencies of 5 KHz and 10 KHz which represent the binary message units "1" and "0" respectively. The signal received by antenna 36 is sent to preamplifier/clipper 60 which delivers a controlled amplitude signal to filters 62 and 64. The bandwidth of filter 62 contains the 5 KHz message frequency representing the "1" message units and the bandwidth of filter 64 contains the 10 KHz message frequency representing the "0" message units. A threshold detector 66 provides an enable signal to the comparator 76 and the decoder tree 80 of the disclosed command signal decoder so that the decoder will be operative only when the amplitudes of frequencies filtered by filters 62 or 64 are of at least a predetermined minimum level.

The amplitudes of frequencies isolated by filters 62 and 64 are amplified to a predetermined limited maximum by limiting amplifier 68. Limiting amplifier 68 is used to establish "capture effect" which allows the message frequencies of the vehicle speed command signal to screen out conflicting extraneous signals received by antenna 36 so that the decoded speed signal is determined from the message frequencies of the vehicle command signal. The amplitudes of the message frequencies are sufficiently greater than the amplitudes of extraneous signals received by antenna 36 so that the input to the limiting amplifier 68 is determined by the message frequencies. The gain of the limiting amplifier 68 is high enough that any input signal having an amplitude which satisfies threshold detector 66 will result in a limiting amplifier output of a limited maximum amplitude. Therefore, the output of limiting amplifier 68 is a signal having a predetermined maximum amplitude and whose frequency is determined by the message frequencies of the speed command signal.

These amplified frequencies are delivered to filter detectors 70 and 72. Filter detector 70 detects the presence of the 5 KHz message frequency related to the "1" message units and conveys "1" and "0" message units (the presence or absence of the "1" frequency respectively) to six-bit delay 74. The detected message unit is delayed in six-bit delay 74 until six message units are subsequently introduced at which time the first message unit is delivered to bit-by-bit comparator 76. Filter detector 72 detects, in a fashion complementary to filter-detector 70, the presence of the 10 KHz message frequency related to the "0" message units and conveys "0" and "1" message units (the presence or absence of the "0" frequency respectively) to inverter 78. The detected message unit is inverted by inverter 78 and delivered to bit-by-bit comparator 76. Therefore, the message units compared in bit-by-bit comparator 76 are the delayed message unit detected by filter detector 70 and the inverted message unit detected by filter-detector 72.

If an enable signal is provided to bit-by-bit comparator 76 from threshold detector 66, and if the delayed message unit and the inverted message unit correspond, the message unit is transferred from the bit-by-bit comparator 76 to serial-to-parallel shift register 79 according to synchronous clock 82. The synchronous clock 82 determines the rate of message unit storage in the serial-to-parallel shift register 79 according to the detection of a "1" message unit by filter detector 70 and a "0" message unit by filter detector 72. If the enable signal of threshold detector 66 is present, and if the serial-to-parallel shift register 79 contains six message units so as to comprise a message word, decoder tree 80 decodes a speed signal from the message units stored in shift register 79. Each message unit which is transferred from the bit-by-bit comparator 76 is sequentially shifted through serial-to-parallel shift register 79 by synchronous clock 82 as subsequent message units are detected.

If, however, the delayed message unit and the inverted message unit do not correspond, the bit-by-bit comparator 76 transfers a reset signal to serial-to-parallel shift register 79 which clears shift register 79 of all previously stored message units thereby causing decoder tree 80 to have no output until the serial-to-parallel shift register 79 again contained enough message units to comprise a message word. Therefore, each time the delayed message unit detected by filter detector 70 does not correspond with the inverted message unit detected by filter-detector 72, the serial-to-parallel shift register 79 is reset and no message word is decoded until a new message word is stored.

Figure 4:
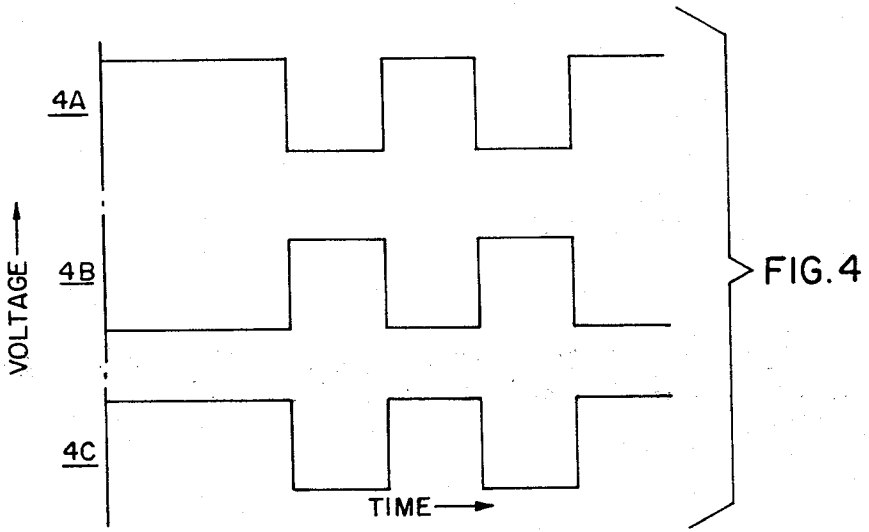
FIG. 4 represents waveforms found at various points in the preferred embodiment of FIG. 3.

Unlike the decoder of the prior art, the present invention compares a delayed message unit detected from one message frequency with an inverted message unit detected from a second message frequency. Whenever the first message unit is complementary to the second message unit and the second message unit is then inverted, the two signals will correspond provided both are accurately detected. For example, curve 4A of FIG. 4 represents the binary message word 110101 as detected by filter detector 70 (FIG. 3) from the 5 KHz message frequency and curve 4B of FIG. 4 represents the same message word as detected by filter detector 72 (FIG. 3) from the 10 KHz message frequency. Curve 4C of FIG. 4 represents the message word of curve 4B inverted by inverter 78. It can be seen that the waveforms of curves 4A and 4C are identical. In addition to using one message frequency to check the validity of the other, the present invention checks the validity of one message frequency against the history of the other message frequency. Therefore, if there is a change in the speed command message or if there is a periodic error in the detection of the first message frequency, the delayed first message frequency will not compare with the inverted second message frequency and the shift register 79 will be reset. The first delayed message frequency may not compare with the second inverted message frequency due to noise in the signal received, transient responses in the filters of the receiver, a component failure in the receiver, or a change in the vehicle command signal. Whenever one of these circumstances occurs, shift register 79 is reset and there is no output from the decoder tree 80. Since, for this system, no output from the decoder tree is considered to be safe condition; the disclosed decoder is said to fail in a safe manner.

We claim:

1. In a transportation vehicle control system having a vehicle receiver for decoding a vehicle command signal having complementary message signals which carry coded information, the apparatus comprising:

means for isolating signals which are substantially equal to said message signals of said vehicle command signal;

means for amplifying said message signals;

first and second means for detecting first and second messages from said first and second message signals respectively;

means for delaying said first detected message;

means for storing, in a fail-safe manner, said delayed message when it is substantially equal to said second detected message; and means for decoding said stored message.

2. The receiver claimed in claim 1 including:

means for resetting said stored message when said delayed message is substantially different from said second detected message.

3. In a transportation vehicle control system having a vehicle receiver for decoding a vehicle command signal having first and second message signals, the apparatus comprising:

means for isolating signals which are substantially equal to said first and second message signals;

means for amplifying said first and second message signals;

first and second means for detecting a message from said first and second message signals respectively;

means for delaying said first detected message;

means for inverting said second detected message;

means for comparing said delayed message and said inverted message in a fail-safe manner;

means for storing said delayed message when it is substantially equal to said inverted message; and means for decoding said stored messages.

* * * * *